US006215255B1

(12) United States Patent
Kim et al.

(10) Patent No.: US 6,215,255 B1
(45) Date of Patent: Apr. 10, 2001

(54) ELECTRIC BALLAST SYSTEM

(75) Inventors: Dae-Bong Kim, Incheon; Nak-Choon Choi, Kyungki-do, both of (KR)

(73) Assignee: Fairchild Korea Semiconductor Ltd. (KR)

( * ) Notice: Subject to any disclaimer, the term of this patent is extended or adjusted under 35 U.S.C. 154(b) by 0 days.

(21) Appl. No.: 09/561,679

(22) Filed: May 1, 2000

(30) Foreign Application Priority Data

Apr. 30, 1999 (KR) ..... 99-15662

(51) Int. Cl.[7] ..... G05F 1/00

(52) U.S. Cl. ..... 315/291; 315/209 R; 315/127; 315/224; 315/DIG. 4

(58) Field of Search ..... 315/209 R, 307, 315/224, 291, 244, 127, DIG. 4, DIG. 7

(56) References Cited

U.S. PATENT DOCUMENTS 5,315,214 * 5/1994 Lesea ..... 315/209 R
5,363,020 * 11/1994 Chen et al. ..... 315/209 R
5,942,859 * 8/1999 Okude et al. ..... 315/291

* cited by examiner

*Primary Examiner*—Haissa Philogene
(74) *Attorney, Agent, or Firm*—Blakely Sokoloff Taylor & Zafman

(57) ABSTRACT

Disclosed is an electric ballast system. The system comprises a voltage source for supplying power to the electric ballast system; a lamp driving circuit having a first terminal, a second terminal, and a third terminal, the power of the voltage source being supplied through the first terminal to begin the driving of the electric ballast system, and the lamp driving circuit outputting PWM waves through the second and third terminals; a half bridge converter, a first end of which is connected to the second terminal of the lamp driving circuit and a second end of which is connected to the third terminal of the lamp driving circuit, the half bridge converter receiving input through the second and third terminals of the lamp driving circuit, and the half bridge converter performing output of a current which changes flow directions according to the PWM waves output by the lamp driving circuit; a lamp portion, a first end of which is connected to an output end of the half bridge converter, the lamp operating according to the current output by the half bridge converter; and a lamp protector connected between a second end of the lamp and the first terminal of the lamp driving circuit, the lamp protector discontinuing the operation of the lamp driving circuit if there is no bulb installed in the lamp.

10 Claims, 3 Drawing Sheets

ELECTRIC BALLAST SYSTEM

BACKGROUND OF THE INVENTION (a) Field of the Invention

The present invention relates to an electric ballast system, and more particularly, to a control circuit for an electric ballast system.

(b) Description of the Related Art

Electric ballast systems perform the initial driving of a lamp and thereafter supply stable power to the lamp. The conventional electric ballast system is typically comprised of a DC-DC converter for supplying DC power, and a lamp driving circuit for controlling the driving of a lamp. In such a conventional ballast system, power is supplied to the lamp driving circuit from a point at which an upper switch and a lower switch of the DC-DC converter meet. That is, power is supplied from this point without passing through the lamp.

However, the supply of power to the lamp driving circuit in the manner described above has many drawbacks. In particular, during a soft start or dimming, driving frequencies of the lamp quicken and a dead time decreases. At this time, a capacitor for supplying power to the lamp driving circuit limits the dead time operation. That is, a voltage of the point between the switches does not become zero during switching as a result of the capacitor connected between the upper and lower switches of the DC-DC converter. Hence, zero voltage switching is not able to occur, a temperature of a switching MOSFET increases, and normal lamp operation becomes difficult.

Further, since power is supplied to the lamp driving circuit without passing through the lamp, if there is no bulb in the lamp, power is continuously supplied to the lamp driving circuit, causing the switching MOSFET to burn out. To prevent such a problem, a protection circuit must be additionally installed in the lamp driving circuit.

SUMMARY OF THE INVENTION

The present invention has been made in an effort to solve the above problems.

It is an object of the present invention to provide an electric ballast system which can operate normally without relation to changes in driving frequencies.

It is another object of the present invention to provide an electric ballast system which discontinues the operation of a lamp driving circuit when there is no bulb in a lamp such that an additional protection circuit is not required.

To achieve the above objects, the present invention provides an electric ballast system comprising a voltage source for supplying power to the electric ballast system; a lamp driving circuit having a first terminal, a second terminal, and a third terminal, the power of the voltage source being supplied through the first terminal to begin the driving of the electric ballast system, and the lamp driving circuit outputting PWM waves through the second and third terminals; a half bridge converter, a first end of which is connected to the second terminal of the lamp driving circuit and a second end of which is connected to the third terminal of the lamp driving circuit, the half bridge converter receiving input through the second and third terminals of the lamp driving circuit, and the half bridge converter performing output of a current which changes flow directions according to the PWM waves output by the lamp driving circuit; a lamp portion, a first end of which is connected to an output end of the half bridge converter, the lamp operating according to the current output by the half bridge converter; and a lamp protector connected between a second end of the lamp and the first terminal of the lamp driving circuit, the lamp protector discontinuing the operation of the lamp driving circuit if there is no bulb installed in the lamp.

According to a feature of the present invention, the electric ballast system further comprises a first resistor connected between the voltage source and the first terminal of the lamp driving circuit; a first capacitor connected between a ground and a common terminal of a fourth resistor and the first terminal of the lamp driving circuit, the first capacitor being charged by a current input through the fourth resistor; and a first diode connected between a ground and a common terminal of a third capacitor and the first terminal of the lamp driving circuit, the first diode acting to maintain a charge voltage of the third capacitor above a predetermined potential.

According to another feature of the present invention, the lamp driving circuit comprises a reference current generator for generating and outputting a reference current; a lamp drive starter for receiving the power of the voltage source through the first terminal of the lamp driving circuit to begin the operation of the lamp driving circuit; a soft starter receiving a starting signal from the lamp drive starter and the reference current from the reference current generator, and outputting a lamp initial drive current to soft start the lamp; a sawtooth wave oscillator for outputting a sawtooth wave current; an adder receiving the lamp initial drive current from the soft starter and the sawtooth wave current from the sawtooth wave oscillator, and adding the lamp initial drive current to the sawtooth wave current and outputting a resulting output current; a first current source connected to the adder to receive the output current of the adder, the first current source selectively dividing the output current of the adder; a PWM wave generator connected to a common terminal of the adder and the first current source, receiving the output current of the adder, and generating and outputting output PWM waves; and a PWM wave splitter receiving the output PWM waves from the PWM wave generator, and alternatingly splitting and outputting the PWM waves through the second and third terminals of the lamp driving circuit.

According to yet another feature of the present invention, the electric ballast system further comprises a second capacitor connected between the soft starter and a ground, the second capacitor determining a soft starting time; a third capacitor connected between a ground and a common terminal of the adder and the PWM wave generator, the third capacitor determining a frequency of the PWM waves; and a second resistor connected between the reference current generator and a ground, the second resistor determining a magnitude of the reference current output by the reference current generator.

According to still yet another feature of the present invention, the soft starter comprises a first switch connected between a ground and the second capacitor, the first switch being controlled to ON if the starting signal of the lamp drive starter is generated, thereby reducing a charge voltage of the second capacitor; a subtractor connected to a common terminal of the first switch and the second capacitor, the subtractor obtaining a difference between a reference voltage and the charge voltage of the second capacitor, and outputting an output voltage corresponding to the difference; and a multiplier receiving the output voltage of the subtractor and the reference current of the reference current generator, and multiplying the output voltage of the subtractor to the reference current of the reference current generator.

According to still yet another feature of the present invention, the PWM wave generator comprises a first comparator receiving a charge voltage of the third capacitor through a first terminal and a first potential through a second terminal, comparing the charge voltage of the third capacitor with the first potential, and outputting a comparison value; a second comparator receiving the charge voltage of the third capacitor through a second terminal and a second potential through a first terminal, comparing the charge voltage of the third capacitor with the second potential, and outputting a comparison value; and a latch receiving the output value of the first comparator and the output value of the second comparator, and outputting a latching value.

According to still yet another feature of the present invention, the half bridge converter comprises a transformer having a primary coil, a first end of the primary coil being connected to the second terminal of the lamp driving circuit and a second end of the primary coil being connected to the third terminal of the lamp driving circuit, and having first and second secondary coils through which the PWM waves of the lamp driving circuit are alternatingly output; a first MOSFET transistor having a source connected to the voltage source, a gate connected to a first end of the first secondary coil of the transformer, and a drain connected to a second end of the first secondary coil of the transformer, the first MOSFET transistor performing switching according to an output waveform of the first secondary coil of the transformer; and a second MOSFET transistor having a drain connected to a common terminal of the drain of the first MOSFET transistor and the first secondary coil of the transformer, a gate connected to a first end of the second secondary coil of the transformer, and a source connected to a second end of the second secondary coil of the transformer, the second MOSFET transistor performing switching according to an output waveform of the second secondary coil of the transformer.

According to still yet another feature of the present invention, the electric ballast system further comprises a third resistor connected between the first secondary coil of the transformer and the gate of the first MOSFET transistor, the third resistor preventing an excess current from flowing to the first MOSFET transistor; and a fourth resistor connected between the second secondary coil of the transformer and the gate of the second MOSFET transistor, the fourth resistor preventing an excess current from flowing to the second MOSFET transistor.

According to still yet another feature of the present invention, the lamp portion comprises an inductor connected to a common terminal of the first MOSFET transistor and the second MOSFET transistor; a lamp, a first end of which is connected to the inductor; a fourth capacitor connected in parallel to the lamp; a fifth capacitor connected between a second end of the lamp and a common terminal of the voltage source and the first MOSFET transistor; and a sixth capacitor connected between the source of the second MOSFET transistor and a common terminal of the second end of the lamp and the fourth capacitor.

According to still yet another feature of the present invention, the lamp protector comprises a seventh capacitor, one end of which is connected to a common terminal of the fifth capacitor and the sixth capacitor; a second diode having a cathode connected to the sixth capacitor, and an anode connected to a common terminal of the source of the second MOSFET transistor and the fifth capacitor; and a third diode having an anode connected to a common terminal of the sixth capacitor and the cathode of the second diode, and a cathode connected to the first terminal of the lamp driving circuit.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
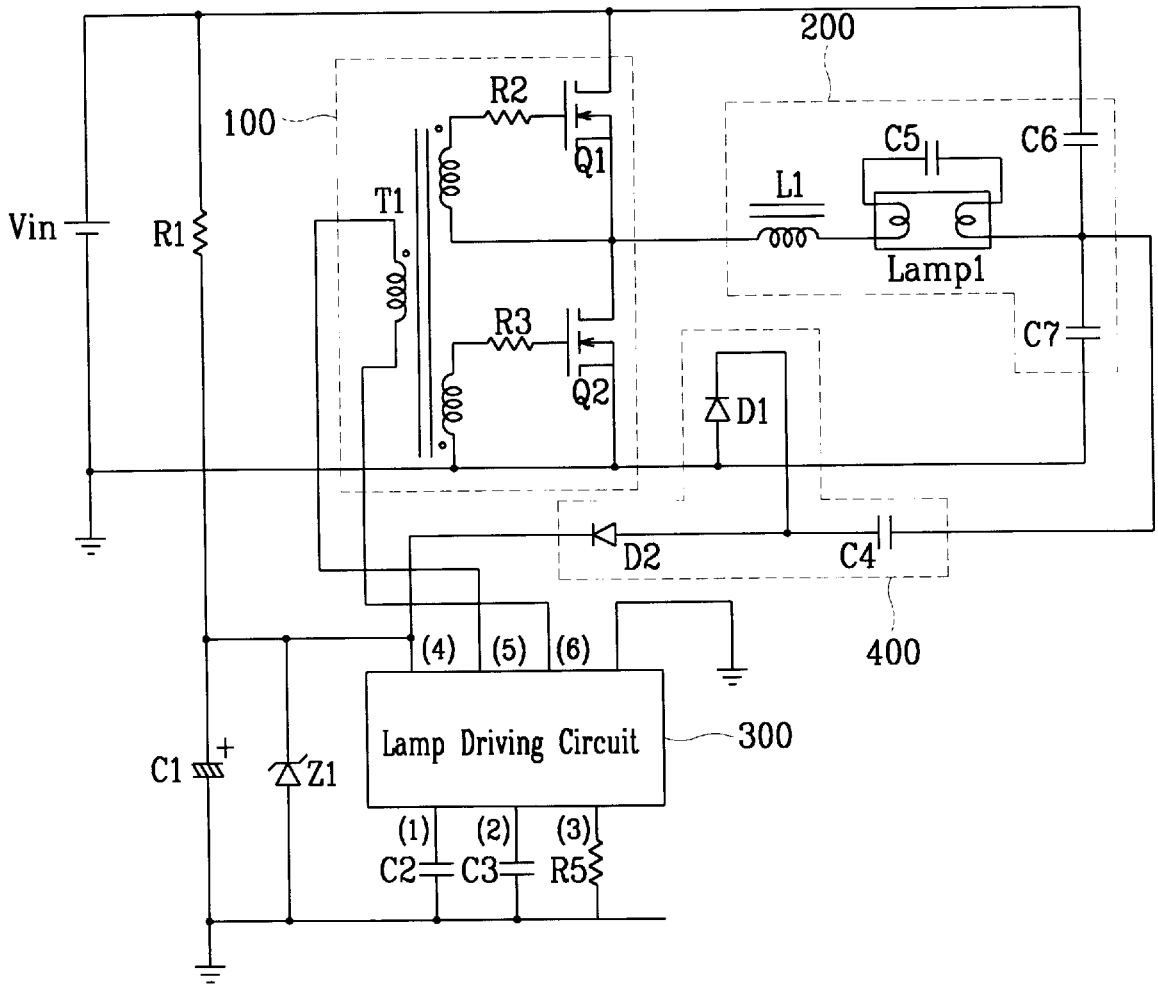
FIG. 1 is a circuit diagram of an electric ballast system according to a preferred embodiment of the present invention.

FIG. 1 shows a circuit diagram of an electric ballast system according to a preferred embodiment of the present invention.

As shown in the drawing, the electric ballast comprises a voltage source Vin; a half bridge converter 100; a lamp portion 200; a lamp driving circuit 300; a lamp protector 400; resistors R1 and R5; capacitors C1, C2 and C3; and a diode Z1.

A first end of the resistor R1 is connected to the power source Vin; the half bridge converter 100 is also connected to the power source Vin; the lamp portion 200 is connected to the half bridge converter 100; the lamp protector 400 is connected to the lamp portion 200; and the lamp driving circuit 300 has six terminals (1) through (6), the terminals (5) and (6) being respectively connected to each end of the half bridge converter 100, and the terminal (4) being connected to both the resistor R1 and the lamp protector 400. Further, the capacitor C2 is connected to the terminal (1); the capacitor C3 is connected between the terminal (2) and the capacitor C2; the resistor R5 is connected between the terminal (3) and a common terminal of the capacitors C2 and C3; the diode Z1 is connected between a common terminal of the terminal (4) and the resistor R1 and a common terminal of the capacitors C2 and C3 and the resistor R5; and the capacitor C1 is connected in parallel to the diode Z1.

The half bridge converter 100 includes resistors R2 and R3, a transformer T1, and transistors Q1 and Q2. The transformer T1 has two secondary coils—an upper secondary coil and a lower secondary coil. Also, a first end and a second end of a primary coil of the transformer T1 are respectively connected to the terminal ⑤ and the terminal ⑥ of the lamp driving circuit 300. The resistor R2 is connected to the upper secondary coil of the transformer T1 and the resistor R3 is connected to the lower secondary coil of the transformer T1. Further, a source of the transistor Q1 is connected to the voltage source Vin, a gate of the transistor Q1 is connected to the resistor R2, and a drain of the transistor Q1 is connected to the lower secondary coil of the transformer T1. In addition, a drain of the transistor Q2 is connected to a common terminal of the drain of the transistor Q1 and the upper secondary coil of the transformer T1, a gate of the transistor Q2 is connected to the resistor R3, and a source of the transistor Q2 is connected to the lower secondary coil of the transformer T1.

The lamp portion 200 includes an inductor L1; capacitors C5, C6 and C7; and a lamp Lamp1. A first end of the inductor L1 is connected to a common terminal of the transistor Q1 and the transistor Q2, and a second end of the inductor L1 is connected to the lamp Lamp1. The capacitor C5 is connected in parallel to both ends of the lamp Lamp1, the capacitor C6 is connected between the voltage source Vin and a common terminal of the lamp Lamp1 and the capacitor C5, and the capacitor C7 is connected between the common terminal of the lamp Lamp1 and the capacitor C5 and the source of the transistor Q2.

The lamp protector 400 includes a capacitor C4 and diodes D1 and D2. The capacitor C4 is connected to a common terminal of the capacitor C6, the capacitor C7, and the lamp Lamp1. Also, a cathode of the diode D1 is connected to the capacitor C4, an anode of the diode D1 is connected to the source of the transistor Q2, an anode of the diode D2 is connected to a common terminal of the capacitor and the diode D1, and a cathode of the diode D2 is connected to the terminal ④ of the lamp driving circuit 300.

Figure 2:
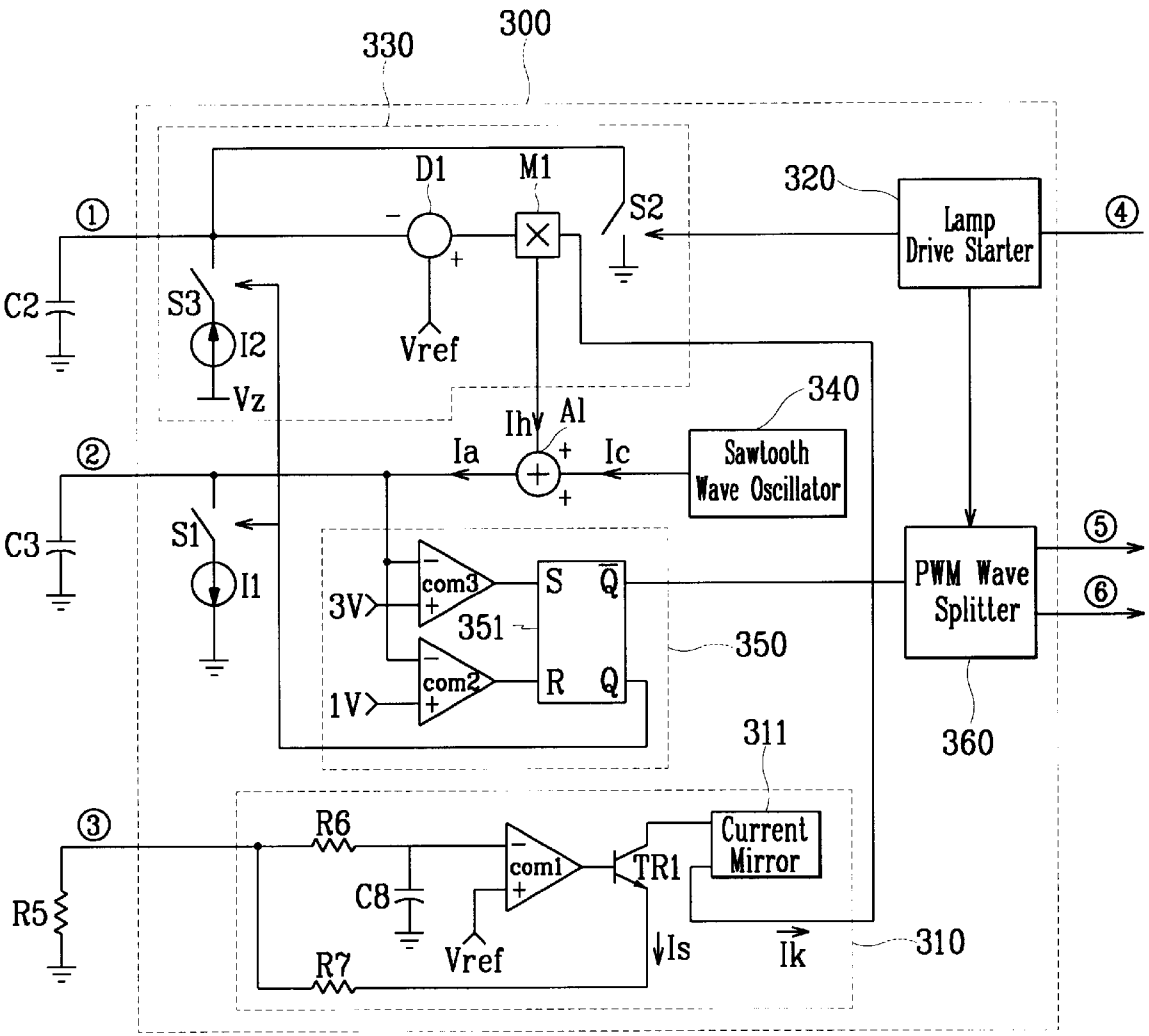
FIG. 2 is a detailed circuit diagram of a lamp driving circuit shown in FIG. 1.

FIG. 2 shows a detailed circuit diagram of the lamp driving circuit 300. As shown in the drawing, the lamp driving circuit 300 includes a reference current generator 310, a lamp drive starter 320, a soft starter 330, a sawtooth wave oscillator 340, an adder A1, a current source I1, a PWM wave generator 350, and a PWM wave splitter 360. The reference current generator 310 is connected to the terminal (3) of the lamp driving circuit 300, the lamp drive starter 320 is connected to the terminal (4) of the lamp driving circuit 300, and the soft starter 330 is connected to both the reference current generator 310 and the lamp drive starter 320. Further, the sawtooth wave oscillator 340 and the soft starter 330 are connected to the adder A1; the adder A1 is connected to the terminal (2) of the lamp driving circuit 300 and the current source I1 the PWM wave generator 350 is connected to a common terminal of the current source I1, the adder A1, and the terminal (2) of the lamp driving circuit 300; the PWM wave splitter 360 is connected to the PWM wave generator 350 and the lamp drive starter 320; and an output terminal of the PWM wave splitter 360 is connected to the terminals (5) and (6) of the lamp driving circuit 300.

The reference current generator 310 includes resistors R6 and R7, a capacitor C8, a comparator COM1, and a transistor TR1. A first end of the resistor R6 is connected to the terminal (3) of the lamp driving circuit 300, the capacitor C8 is connected between a second end of the resistor R6 and a ground, a negative terminal of the comparator COM1 is connected to a common terminal of the capacitor C8 and the resistor R6, and a positive terminal of the comparator COM1 is connected to a reference voltage Vref. Also, a base of the transistor TR1 is connected to an output terminal of the comparator COM1, an emitter of the transistor is connected to the resistor R7, and a collector of the transistor TR1 is connected to a current mirror 311.

The soft starter 330 includes a current source 12, switches S2 and S3, a subtractor D1, and a multiplier M1. The switch S2 is connected between the lamp drive starter 320 and the terminal (1) of the lamp driving circuit 300, the switch S3 is connected to the terminal (1) of the lamp driving circuit 300, the current source 12 is connected between the switch S3 and a ground, the subtractor D1 is connected to the terminal (1) of the lamp driving circuit 300, and the multiplier M1 is connected to the subtractor D1 and the current mirror 311.

The PWM wave generator 350 includes comparators COM2 and COM3, and a latch 351. A positive terminal of the comparator COM2 receives an input of 1V, a negative terminal of the comparator COM2 receives a charge voltage of the capacitor C3, a positive terminal of the comparator COM3 receives the charge voltage of the capacitor C3, and a negative terminal of the comparator COM3 receives an input of 3V. Further, an R terminal of the latch 351 is connected to an output terminal of the comparator COM2, and an S terminal of the latch 351 is connected to an output terminal of the comparator COM3.

An operation of the electric ballast system of the present invention structured as in the above will now be described with reference to FIGS. 1 and 2.

The electric ballast system receives power through the input of the voltage source Vin, thereby beginning the operation of the electric ballast system. A current supplied from the voltage source Vin passes through the resistor R1 to charge the capacitor C1. If a charge voltage of the capacitor C1 exceeds a predetermined level, the lamp driving circuit 300 begins to operate. That is, when a voltage input to the terminal (4) exceeds a predetermined level, the lamp drive starter 320 begins to operate, which, in turn, controls the switch S2 from OFF to ON. Further, since the switch S3 is initially in an ON state, if the switch S2 is controlled to OFF when a charge voltage Vc2 of the capacitor C2 is in a ground voltage state, the charge voltage Vc2 of the capacitor C2 increases. At this time, a rate at which the charge voltage of the capacitor C2 increases is determined by the capacitor C2. That is, if a capacity of the capacitor C2 is small, the charge voltage Vc2 of the capacitor C2 is more quickly increased, and if the capacity of the capacitor C2 is large, the rate at which the charge voltage Vc2 of the capacitor C2 increases is decreased. Accordingly, the lamp driving circuit 300 can be started by the presence of the capacitor C2.

The reference current generator 310 generates a reference current in the following manner. The reference voltage Vref is supplied to the positive terminal of the comparator COM1, and because a voltage of the negative terminal of the comparator COM1 also becomes the reference voltage and a current flowing to the resistor R6 becomes almost zero, a voltage of the resistor R5 becomes the reference voltage Vref. As a result, a current flowing to the resistor R5 becomes Vref/R5, and since the current flowing to the resistor R6 becomes almost zero, a current Is flowing to the resistor R7 also becomes Vref/R5. The current mirror 311 receives the input of the current Is, then outputs a reference current Ik, the reference current Ik being proportional to the current Is. The reference current Ik output by the reference current generator 310 is determined by a size of the resistor R5, which is connected to the terminal (3) of the lamp driving circuit 300.

The subtractor D1 outputs a difference between the reference voltage Vref and the charge voltage Vc2 of the capacitor C2, and the multiplier M1 multiplies the reference current Ik output from the reference current generator 310 by the difference between the reference voltage Vref and the charge voltage of the capacitor C2 output by the subtractor D1, after which a resulting value is output to the adder A1. The resulting value, or an output current Ih, therefore, is derived by the following calculation: $Ik \times (Vref - Vc2)/Vref$. The output current Ih can be varied as needed, as is understood by those in the art to which the present invention pertains.

The output current Ih of the multiplier M1 and an output sawtooth wave current Ic of the sawtooth wave oscillator 340 are received by the adder A1, after which the adder A1 adds these two values and outputs a resulting current value (i.e., an output current Ia) to the capacitor C3.

Figures 3A, 3B:
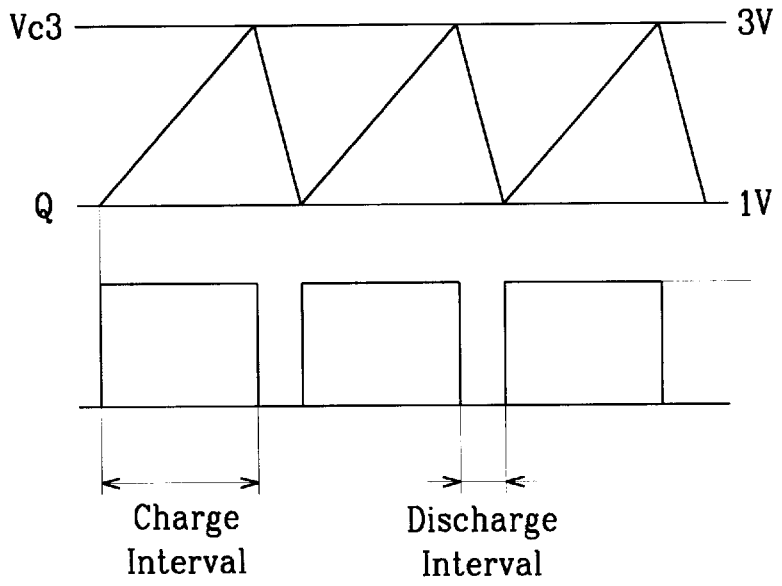
FIGS. 3*a* and 3*b* are a waveform diagram of an operation of the lamp driving circuit shown in FIG. 1.

The charge voltage of the capacitor C3 is shown in FIG. 3.

Since the output current Ia of the adder A1 is the sum of the sawtooth wave current Ic and the output current Ih of the multiplier M1, the output current Ia results in a waveform as shown in (a) of FIG. 3 such that the charge voltage of the capacitor C3 is also depicted by (a) of FIG. 3. The charge voltage of the capacitor C3 varies between the 3V input voltage of the negative terminal of the comparator COM3 and the 1V input voltage of the positive terminal of the comparator COM2. Here, the input voltage of the negative terminal of the comparator COM3 and the input voltage of the positive terminal of the comparator COM2 can be varied as needed.

Since the charge voltage of the capacitor C3 takes on a sawtooth waveform between 1V and 3V as shown in FIG. 3, an output waveform of the latch 351 results in a waveform as shown by (b) of FIG. 3. The reason for this is as follows. When the charge voltage of the capacitor C3 is at 1V, since an output value of the comparator COM2 (the input value of the R terminal of the latch 351) is 1 and an output value of the comparator COM3 (the input value of the S terminal of the latch 351) is 0, an output value Q of the latch 351 becomes 1. Further, in an interval where the charge voltage of the capacitor C3 increases from 1V to 3V, since the output values of the comparator COM2 and the comparator COM 3 are both 0, the output value Q of the latch 351 is maintained at the previous value of 1. However, when the charge voltage of the capacitor becomes 3V, since the output value of the comparator becomes 1 and the output value of the comparator COM2 becomes 0, the output value Q of the latch 351 becomes 0. In the case where the output value Q of the latch 351 is 1, the switch S1 and the switch S3 are controlled to ON. If the switch S1 is controlled to ON, since the current charged in the capacitor C3 is minimized by as much as a current value of the current source I1, the charge voltage of the capacitor C3 is reduced. At this time, if the current value of the current source 11 is set to be larger than the output current Ia of the adder A1, the voltage of the capacitor C3 is discharged more quickly than when charged such that the charge voltage of the capacitor results in a waveform as shown by (a) of FIG. 3.

In addition, in an interval where the charge voltage of the capacitor C3 reduces from 3V to 1V by the ON operation of the switch S1, since the output values of the comparators COM2 and COM3 become 0, the output value Q of the latch 351 is maintained at the previous value of 0. Accordingly, the output waveform of the latch 351 results in a waveform as shown by (b) of FIG. 3.

The PWM wave splitter 360 splits output PWM waves of the PWM wave generator 350 through the terminals (5) and (6) of the lamp driving circuit 300. That is, the output PWM waves as shown in (b) of FIG. 3 are output alternatingly through terminal (5) then through terminal (6) of the lamp driving circuit 300. By this operation, the lamp driving circuit 300 generates PWM waves, which are input to both ends of the primary coil of the half bridge converter 100.

When the PWM waves are output through the terminal (5) of the lamp driving circuit 300, a current of a counterclockwise direction is induced to the upper secondary coil of the transformer T1, while a current of a clockwise direction is induced to the lower secondary coil of the transformer T1. As a result, the transistor Q1 is controlled to ON and the transistor Q2 is controlled to OFF. In this case, current flows through a path of the transistor Q1, the inductor L1, the lamp Lamp1, and the capacitor C7; as well as a path of the transistor Q1, the inductor L1, the lamp Lamp1, and the capacitor C6. A frequency of this current is a resonance frequency between the inductor L1 and the capacitor C7.

When the PWM waves are output through the terminal (6) of the lamp driving circuit 300, a current in the clockwise direction is induced to the upper secondary coil of the transformer T1, while a current of a counterclockwise direction is induced to the lower secondary coil of the transformer T1. As a result, the transistor Q1 is controlled to OFF and the transistor Q2 is controlled to ON. In this case, current flows through a path of the capacitor C6, the lamp Lamp1, the inductor L1, and the transistor Q2; as well as a path of the capacitor C7, the lamp Lamp1, the inductor L1, and the transistor Q2. A frequency of this current is a resonance frequency between the inductor L1 and the capacitor C6.

The lamp is operated by the lamp driving circuit 300 using the operational principles as outlined above. In the preferred embodiment of the present invention, the operation of the lamp driving circuit 300 is discontinued by the lamp protector 400 when there is no bulb installed in the lamp.

An operation of the lamp protector 400 will now be described.

The lamp protector 400, with reference to FIG. 1 and as described above, includes the capacitor C4 and the diodes D1 and D2. The capacitor C4 is connected to a common terminal of the capacitor C6, the capacitor C7 and the lamp Lamp1 such that a part of the current applied to the lamp Lamp1 is supplied through the terminal (4) of the lamp driving circuit 300. If a bulb is installed in the lamp Lamp1, the current is supplied to the lamp driving circuit 300, but when there is no bulb, current does not flow through the lamp Lamp1. As a result, current does not flow to the lamp driving circuit 300 through the lamp protector 400. The current supplied through the lamp protector 400 is supplied to the lamp drive starter 320 through the terminal (4) of the lamp driving circuit 300. That is, the current supplied to the lamp drive starter 320 is supplied through the voltage source Vin and the lamp protector 400, and if the current is not supplied through the lamp protector 400, the lamp drive starter 320 does not operate. This is because the lamp drive starter 320 operates only when a current of above a predetermined level is supplied thereto.

As a result, the operation of the lamp drive circuit 300 can be discontinued when there is no bulb installed in the lamp Lamp1, thereby preventing the continuous flow of current to the lamp driving circuit 300 when there is no bulb. Therefore, the burning out of the internal elements of the lamp driving circuit 300 is prevented. Further, a complicated lamp protecting circuit as used in the prior art is not needed.

In addition, since no element is provided at a point where the transistor Q1 and the transistor Q2 meet, the transistors Q1 and Q2 can perform zero voltage switching. Accordingly, an increase in the operational temperature of the transistors Q1 and Q2, which causes the lamp driving circuit 300 to malfunction, is prevented.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An electric ballast system comprising:

a voltage source for supplying power to the electric ballast system;

a lamp driving circuit having a first terminal, a second terminal, and a third terminal, the power of the voltage source being supplied through the first terminal to begin the driving of the electric ballast system, and the lamp driving circuit outputting PWM waves through the second and third terminals;

a half bridge converter, a first end of which is connected to the second terminal of the lamp driving circuit and a second end of which is connected to the third terminal of the lamp driving circuit, the half bridge converter receiving input through the second and third terminals of the lamp driving circuit, and the half bridge converter performing output of a current which changes flow directions according to the PWM waves output by the lamp driving circuit;

a lamp portion, a first end of which is connected to an output end of the half bridge converter, the lamp operating according to the current output by the half bridge converter; and a lamp protector connected between a second end of the lamp and the first terminal of the lamp driving circuit, the lamp protector discontinuing the operation of the lamp driving circuit if there is no bulb installed in the lamp.

2. The electric ballast system of claim 1 further comprising:

a first resistor connected between the voltage source and the first terminal of the lamp driving circuit;

a first capacitor connected between a ground and a common terminal of a first resistor and the first terminal of the lamp driving circuit, the first capacitor being charged by a current input through the first resistor; and a first diode connected between a ground and a common terminal of a third capacitor and the first terminal of the lamp driving circuit, the first diode acting to maintain a charge voltage of the third capacitor above a predetermined potential.

3. The electric ballast system of claim 1 wherein the lamp driving circuit comprises:

a reference current generator for generating and outputting a reference current;

a lamp drive starter for receiving the power of the voltage source through the first terminal of the lamp driving circuit to begin the operation of the lamp driving circuit;

a soft starter receiving a starting signal from the lamp drive starter and the reference current from the reference current generator, and outputting a lamp initial drive current to soft start the lamp;

a sawtooth wave oscillator for outputting a sawtooth wave current;

an adder receiving the lamp initial drive current from the soft starter and the sawtooth wave current from the sawtooth wave oscillator, and adding the lamp initial drive current to the sawtooth wave current and outputting a resulting output current;

a first current source connected to the adder to receive the output current of the adder, the first current source selectively dividing the output current of the adder;

a PWM wave generator connected to a common terminal of the adder and the first current source, receiving the output current of the adder, and generating and outputting output PWM waves; and a PWM wave splitter receiving the output PWM waves from the PWM wave generator, and alternatingly splitting and outputting the PWM waves through the second and third terminals of the lamp driving circuit.

4. The electric ballast system of claim 3 further comprising:

a second capacitor connected between the soft starter and a ground, the second capacitor determining a soft starting time;

a third capacitor connected between a ground and a common terminal of the adder and the PWM wave generator, the third capacitor determining a frequency of the PWM waves; and a second resistor connected between the reference current generator and a ground, the second resistor determining a magnitude of the reference current output by the reference current generator.

5. The electric ballast system of claim 4 wherein the soft starter comprises:

a first switch connected between a ground and the second capacitor, the first switch being controlled to ON if the starting signal of the lamp drive starter is generated, thereby reducing a charge voltage of the second capacitor;

a subtractor connected to a common terminal of the first switch and the second capacitor, the subtractor obtaining a difference between a reference voltage and the charge voltage of the second capacitor, and outputting an output voltage corresponding to the difference; and a multiplier receiving the output voltage of the subtractor and the reference current of the reference current generator, and multiplying the output voltage of the subtractor to the reference current of the reference current generator.

6. The electric ballast system of claim 5 wherein the PWM wave generator comprises:

a first comparator receiving a charge voltage of the third capacitor through a first terminal and a first potential through a second terminal, comparing the charge voltage of the third capacitor with the first potential, and outputting a comparison value;

a second comparator receiving the charge voltage of the third capacitor through a second terminal and a second potential through a first terminal, comparing the charge voltage of the third capacitor with the second potential, and outputting a comparison value; and a latch receiving the output value of the first comparator and the output value of the second comparator, and outputting a latching value.

7. The electric ballast system of claim 1 wherein the half bridge converter comprises:

a transformer having a primary coil, a first end of the primary coil being connected to the second terminal of the lamp driving circuit and a second end of the primary coil being connected to the third terminal of the lamp driving circuit, and having first and second secondary coils through which the PWM waves of the lamp driving circuit are alternatingly output;

a first MOSFET transistor having a source connected to the voltage source, a gate connected to a first end of the first secondary coil of the transformer, and a drain connected to a second end of the first secondary coil of the transformer, the first MOSFET transistor performing switching according to an output waveform of the first secondary coil of the transformer; and a second MOSFET transistor having a drain connected to a common terminal of the drain of the first MOSFET transistor and the first secondary coil of the transformer, a gate connected to a first end of the second secondary coil of the transformer, and a source connected to a second end of the second secondary coil of the transformer, the second MOSFET transistor performing switching according to an output waveform of the second secondary coil of the transformer.

8. The electric ballast system of claim 7 further comprising:

a third resistor connected between the first secondary coil of the transformer and the gate of the first MOSFET transistor, the third resistor preventing an excess current from flowing to the first MOSFET transistor; and a fourth resistor connected between the second secondary coil of the transformer and the gate of the second MOSFET transistor, the fourth resistor preventing an excess current from flowing to the second MOSFET transistor.

9. The electric ballast system of claim 8 wherein the lamp portion comprises:

an inductor connected to a common terminal of the first MOSFET transistor and the second MOSFET transistor;

a lamp, a first end of which is connected to the inductor;

a fourth capacitor connected in parallel to the lamp;

a fifth capacitor connected between a second end of the lamp and a common terminal of the voltage source and the first MOSFET transistor; and a sixth capacitor connected between the source of the second MOSFET transistor and a common terminal of the second end of the lamp and the fifth capacitor.

10. The electric ballast system of claim 9 wherein the lamp protector comprises:

a seventh capacitor, one end of which is connected to a common terminal of the fifth capacitor and the sixth capacitor;

a second diode having a cathode connected to the seventh capacitor, and an anode connected to a common terminal of the source of the second MOSFET transistor and the sixth capacitor; and a third diode having an anode connected to a common terminal of the seventh capacitor and the cathode of the second diode, and a cathode connected to the first terminal of the lamp driving circuit.

* * * * *